US006779792B2

(12) United States Patent
Lyga et al.

(10) Patent No.: US 6,779,792 B2
(45) Date of Patent: Aug. 24, 2004

(54) JAM RELEASE MECHANISM FOR A MAILING MACHINE

(75) Inventors: Thomas M. Lyga, Southbury, CT (US); Geoffrey S. Coleman, Ansonia, CT (US)

(73) Assignee: Pitney Bowes Inc., Stamford, CT (US)

( * ) Notice: Subject to any disclaimer, the term of this patent is extended or adjusted under 35 U.S.C. 154(b) by 73 days.

(21) Appl. No.: 10/282,310

(22) Filed: Oct. 28, 2002

(65) Prior Publication Data

US 2004/0080103 A1 Apr. 29, 2004

(51) Int. Cl.[7] ..... B65H 5/02
(52) U.S. Cl. ..... 271/273; 271/2
(58) Field of Search ..... 271/273, 274, 271/2

(56) References Cited

U.S. PATENT DOCUMENTS

| | | | | |
|---|---|---|---|---|
| 4,570,923 | A | 2/1986 | Hooper et al. | |
| 4,775,140 | A | 10/1988 | Foster | |
| 5,011,129 | A | 4/1991 | Holbrook | |
| 5,120,043 | A | 6/1992 | Marzullo | |
| 5,433,431 | A | 7/1995 | Lowell | |
| 5,454,554 | A | 10/1995 | Boughton et al. | |
| 5,697,880 | A | 12/1997 | Auerbach | |
| 6,598,870 | B2 * | 7/2003 | Hanano | 271/138 |

* cited by examiner

*Primary Examiner*—Donald P. Walsh
*Assistant Examiner*—Kaitlin Joerger
(74) *Attorney, Agent, or Firm*—Brian A. Lemm; Angelo N. Chaclas

(57) ABSTRACT

Apparatus and methods for clearing a jam that occurs on a mailing machine sheet feeder are presented. An envelope stripper and moistener portion of the mailing machine can include a jam release mechanism that provides for a release handle to unlock an upper transport and swing the transport and related portions of the mailing machine into an upright position leaving a transport deck and blade exposed, and thereby facilitating the clearing of a jammed envelope or other mailing piece. The sheet feeding device can include a feeder portion, an upper transport portion and a transport deck. The jam clearing device can include an upper transport frame pivotally mounted to the sheet feeding device via an upper transport pivot shaft and a latching means for securing the upper transport frame in a home position.

22 Claims, 6 Drawing Sheets

JAM RELEASE MECHANISM FOR A MAILING MACHINE

BACKGROUND

This invention relates generally to the field of sheet feeding, and more particularly to a method and system for gaining access to a transport deck of a mailing machine to remove material thereon.

Generally, a mail piece feeder on a mailing machine transports envelopes and other mailpieces along a deck so that various functions may be performed on the mailpiece at different locations along the deck. For example, one location along a deck may weigh the mailpiece, another location may seal the mailpiece and still another location may apply indicia for postage to the mailpiece. Typically, drive rollers are mounted along the deck with a radial portion contacting each envelope to propel the envelope along the deck. The drive rollers can extend, for example, through aligned cutouts in the deck. The drive rollers move the mailpiece along the deck to different locations on the deck where a function may be performed.

A sealing function performed by a mailing machine can include a structure for deflecting a flap of a moving envelope away from the envelope's body and into engagement with a pad. The structure can include a stripper blade which becomes inserted between the flap of the envelope and the body of the envelope as the envelope traverses the deck. The pad moistens an adhesive which is present on the inner surface of the envelope flap before the envelope is fed into a nip which serves to seal the envelope with the moistened adhesive.

Movement of the envelope against the stripping blade or other points of contact can cause jams which can distort or tear the envelope. Removal of a distorted or torn envelope can result in pieces of the envelope remaining in the drive mechanisms or wedged amongst the stripper blade. Access to the torn pieces would be limited due to upper rollers, guides and the like, which are utilized to transport the envelope along the deck of the mailing machine. Often a tool, such as tweezers or other tool capable of reaching between the low clearance apparatus, would be required to remove a piece of torn envelope that has become wedged between the stripper blade and a transport mechanism and prevent clear passage of subsequent mailpieces.

Therefore, it would be advantageous to provide methods and apparatus that overcame the drawbacks of the prior art. In particular, it would be desirable to provide a method and apparatus that allows a user to gain clear access to an envelope that has become jammed and remove the jammed envelope or piece thereof from the mailing machine.

SUMMARY

Accordingly, the present invention provides apparatus and methods for clearing jams on a mailing machine sheet feeding device. The sheet feeding device can include a feeder portion, a singulator, an upper transport portion, a stripper device and a transport deck. The jam clearing device can include an upper transport frame pivotally mounted to the sheet feeding device via an upper transport pivot shaft and a latching means for securing the upper transport frame in a home position. A handle can be included for releasing the latch from a home position. An upper transport latch pin can be fixedly attached to the sheet feeding device and located to receive the latching means in a closed position, wherein the closed position will suitably position one or more transports for contact with a mail piece on the transport deck. A means can also be included for securing the upper transport portion in an open position.

Embodiments can include a first upper transport positioned to receive a mail piece if the mail piece moves onto the transport deck while the upper transport frame is secured in the home position. The first upper transport can be lifted away from the transport deck when the upper transport frame is placed in the open position. A second upper transport can be positioned to receive a mail piece on the transport deck and move the mail piece beyond the transport deck if the upper transport frame is secured in the home position. The second upper transport can also be lifted away from the transport deck when the upper transport frame is lifted into the open position.

In another aspect, if the upper transport frame is secured in the home position, the separation distance between the first upper transport and the second upper transport can be set to less than the length of a mail piece having a shortest length intended to traverse the sheet feeding device.

Embodiments can also include one or more skis pivotally attached to the upper transport frame and positioned to guide a mail piece while the upper transport frame is secured in the home position. The skis can be lifted away from the transport deck when the upper transport frame is lifted into the open position.

One device that can be utilized to secure the upper transport frame in an open position can include a cam formed into the upper transport frame. Embodiments can include a spring positioned such that the spring torque provides normal pressure against the cam while the upper transport frame is in the open position. While the upper transport frame is in the home position torque from the spring can provide downward pressure against the second upper transport.

Other aspects of a jam clearing device according to the present invention include a stripper blade and a nip following the stripper blade that can be formed by the second upper transport contacting a lower roller. A singulator for creating a stream of single mail pieces can be located prior to the stripper blade.

A handle can be pivotally mounted to the upper transport frame. Embodiments can include a latch and the handle being formed by one homogenous molded piece. The latch can include a hook that engages the latch pin to secure the upper transport in the home position.

Other aspects of the present invention include a method for gaining access to a transport deck on a mailing machine. The method can include releasing an upper transport latch and rotating an upper transport frame around an upper transport frame pivot shaft into an upright position away from the transport deck. For example, the upper transport frame can be rotated clockwise and secured in the upright position over center of the upper transport frame pivot shaft.

Embodiments of the present invention can include an upper transport mechanism for transporting a mail piece along a transport deck on a mailing machine with an upper transport frame rotatively attached to a sheet feeder frame and a first upper transport pivotally attached to the upper transport frame with one or more drive rollers. A second upper transport can also be pivotally attached to the sheet feeder frame and have one or more rollers. A cam can be formed into the upper transport frame, with a cam following portion formed into the second upper transport and spring loaded against the cam with a spring. A latch pin can be fixedly mounted to the sheet feeder frame and a release handle can be pivotally mounted to one end of the upper transport frame where it can engage the latch pin while the upper transport frame is in a home position.

A separation distance between drive rollers on the first upper transport and drive rollers on the second upper transport can be less than the length of a smallest mail piece intended to be transported. Embodiments can also incorporate the upper transport frame being capable of rotating to a position over center of a pivot shaft attaching the upper transport frame to the sheet feeder frame.

Therefore, it should now be apparent that the invention substantially achieves all the above aspects and advantages. Additional aspects and advantages of the invention will be set forth in the description that follows, and in part will be obvious from the description, or may be learned by practice of the invention. Various features and embodiments are further described in the following figures, description and claims.

DESCRIPTION OF THE DRAWINGS

The accompanying drawings illustrate presently preferred embodiments of the invention, and together with the general description given above and the detailed description given below, serve to explain the principles of the invention. As shown throughout the drawings, like reference numerals designate like or corresponding parts.

DETAILED DESCRIPTION

The present invention includes apparatus and methods for clearing a jam that occurs on a sheet feeder, such as, for example, a mailing machine. An envelope stripper and moistener portion of the mailing machine can include a jam release mechanism that provides for a release handle to unlock an upper transport frame and swing the transport frame and related portions of the mailing machine into an upright position leaving a transport deck and stripper blade exposed, and thereby facilitating the clearing of a jammed envelope or other mailing piece.

Figure 1:
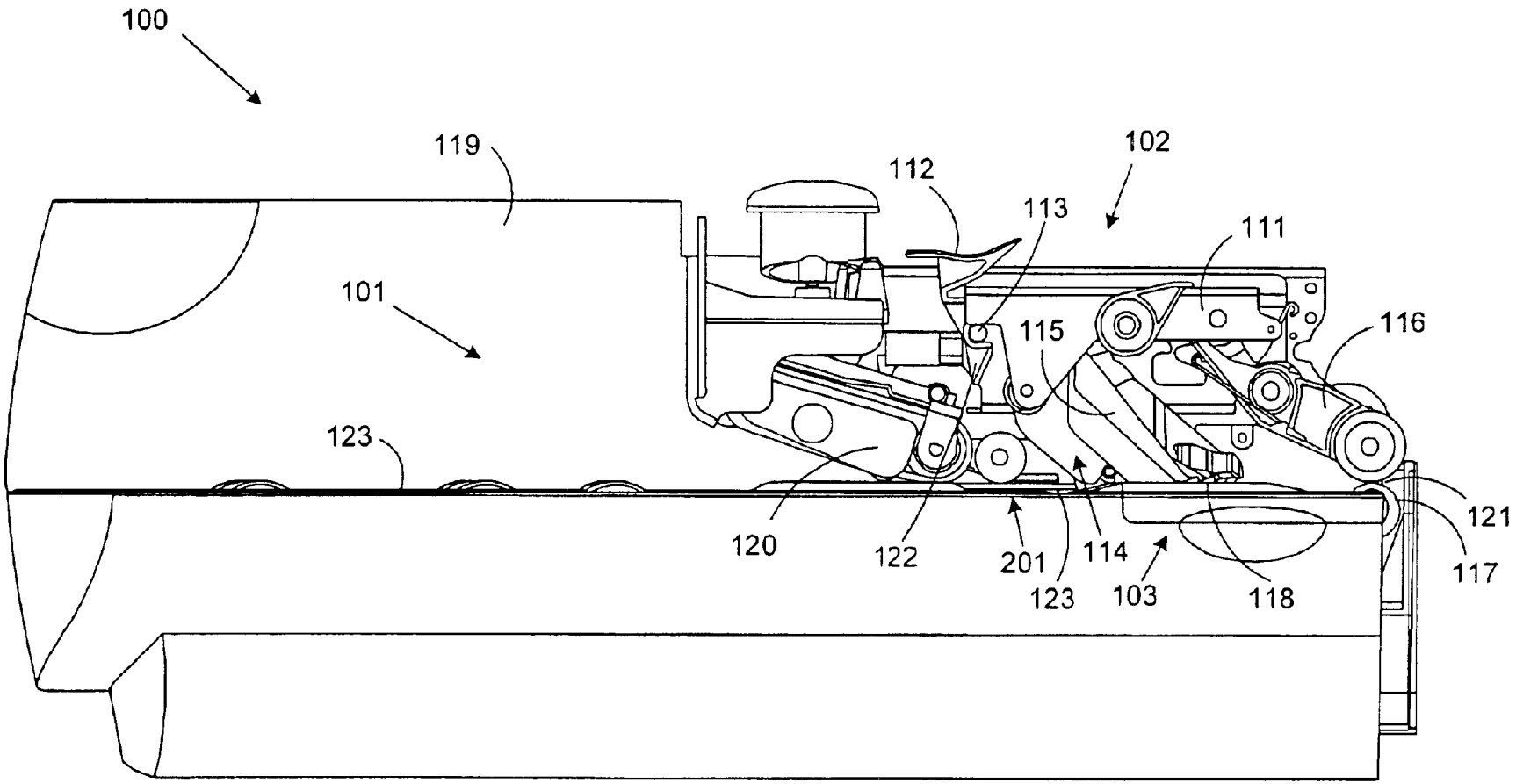
FIG. 1 illustrates a portion of a mailing machine according to the present invention.

Referring now to FIG. 1, basic components included in a mailing machine 100 according to the present invention are illustrated. Generally, a mailing machine 100 can include a feeder portion 101, a singulator 120, an upper transport portion 102 and a mail piece flap separator and moistener portion 103. Mail pieces, such as a stack of envelopes, are stacked against a registration wall 119 in the feeder portion 101 and fed into a singulator 120. The envelopes, or other mail pieces, can be fed, for example, with one or more belt drives and rollers. The singulator 120 can transform a bulk flow of envelopes into a single stream of single envelopes.

Each envelope can pass through the singulator 120 and into a mail flap separator and moistener portion 103, which can include a stripper blade 118. The stripper blade 118 can be utilized to separate a flap portion of an envelope away from a body portion of the envelope and allow the flap to be moistened by a moistener. Optionally, one or more skis 115 can be utilized to guide a transported envelope into the stripper blade 118.

Figure 2:
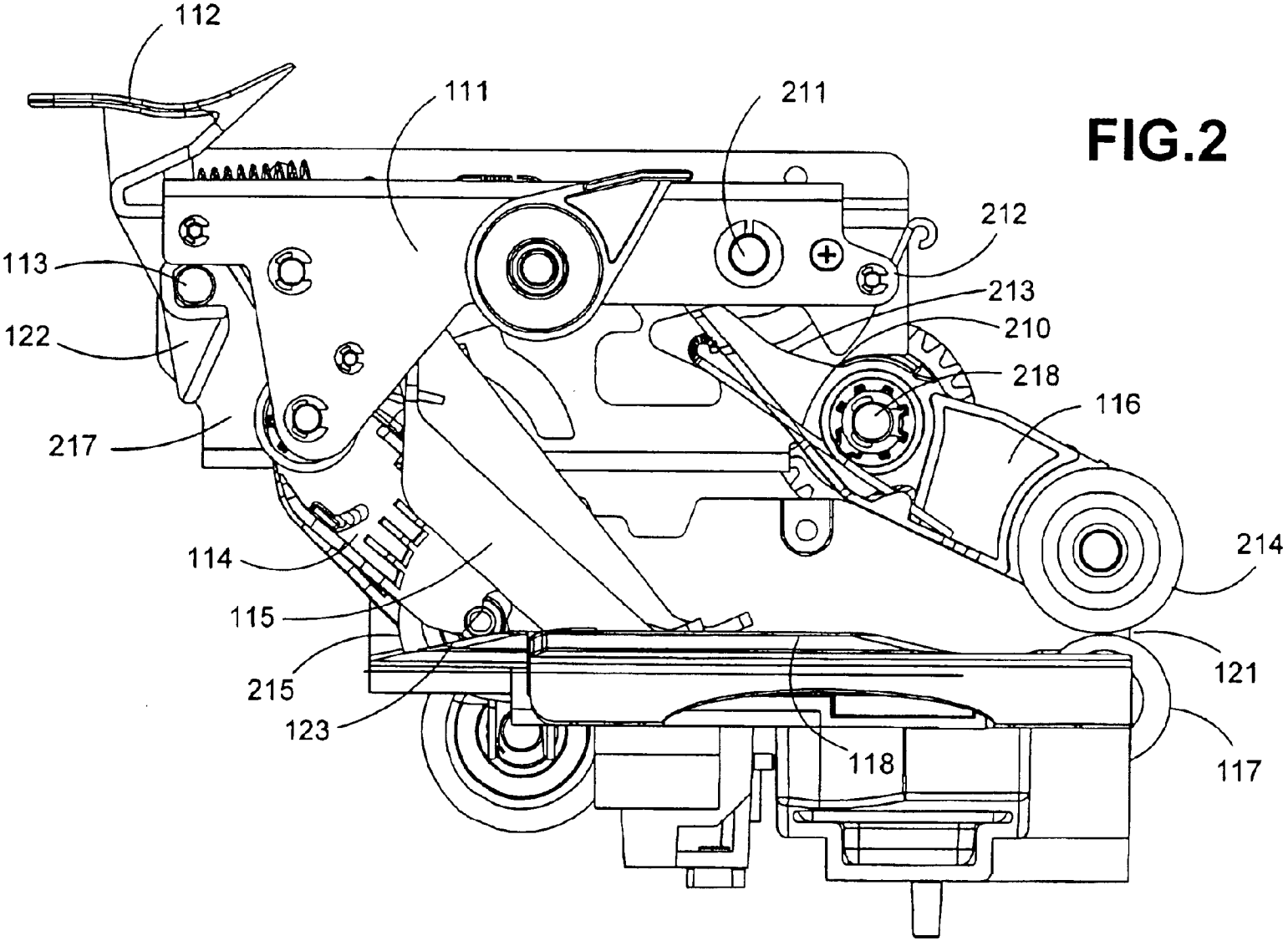
FIG. 2 illustrates a close up of the upper transport portion and moistener portion of a mailing machine according to the present invention.

A first upper transport 114 can be attached to an upper transport frame 111 and a second upper transport 116 can be attached to a sheet feeding frame 217 (FIG. 2). The upper transports 114, 116 can be utilized to move each envelope along a transport deck 123 and through the separator and moistener portion 103 into a nip 121. Movement can be effected by rotational movement of drive rollers, as further discussed below and illustrated in FIG. 2. The nip 121 can be formed by a lower roller 117 positioned below the second upper transport 116 following moistening of the envelope flap.

A release handle 112 can be rotatively attached to the upper transport frame 111 and can be utilized to release an upper transport latch 122 from an upper transport latch pin 113. The upper transport latch 122 can become secured to the upper transport latch pin 113 with a hook, or other securing device. The latch handle 112 can also be spring loaded to return the handle to a home position. Releasing the upper transport latch 122 can unlock the upper transport 102, such that the first upper transport portion 114 can swing upward exposing the transport deck 123 and separator and moistener portion 103 of the mailing machine 100. In addition, the upward movement of the first upper transport 114 can cause the second upper transport 116 to rise upward providing further access to the transport deck.

Referring now to FIG. 2, a close up illustration of the upper transport portion 102 and separator and moistener portion 103 of a mailing machine according to the present invention is shown. According to the present invention, an upper transport shaft 211 can be utilized to rotatively mount the upper transport frame 111 to a sheet feeding frame 217.

The close up additionally illustrates a torsion spring 210 which can provide normal pressure to hold the second transport mechanism 116 against a mail piece traversing the mailing machine 100. The torsion spring 210 can also provide normal pressure against a cam 213 formed into the end of the second upper transport 116 opposing the second drive roller 214. A cam contact, such as a cam engagement rod 212 can be formed into, or fixedly attached to the upper transport frame 111. The cam engagement rod 212 can be inserted through the upper transport frame 111 and span across the upper transport frame 111 at an end opposing the end connected to the first upper transport 114. The cam 213 can be positioned to provide mechanical contact with the cam engagement rod 212, such that movement of the cam engagement rod 212 will transfer to the cam 213 and cause the second upper transport 116 to rotate around a pivot 218. Rotation around the pivot 218 will cause the second upper transport 116 to lift up away from the transport deck 123. Such movement can be created in the cam engagement rod 212 if the release handle 112 releases the upper transport latch 122 from the latch pin 113 and the release handle 112 is lifted upward.

FIG. 2 also illustrates a first drive roller 215 included in the first upper transport 114 and a second drive roller 214 included in the second upper transport 116. Each upper transport 114, 116 can include one or more drive rollers 214, 215 which are rotatively mounted into each respective upper transport 114, 116. The rollers 214, 215 can be positioned such that while the upper transport is in the home position, the rollers 214, 215 will contact a mail piece traversing the transport deck 123. Embodiments can include maintaining a separation distance between the rollers 214, 215 that is less than the length of a smallest mail piece that is intended to traverse the mailing machine 100, while the upper transport 102 is in the home position.

Figure 3:
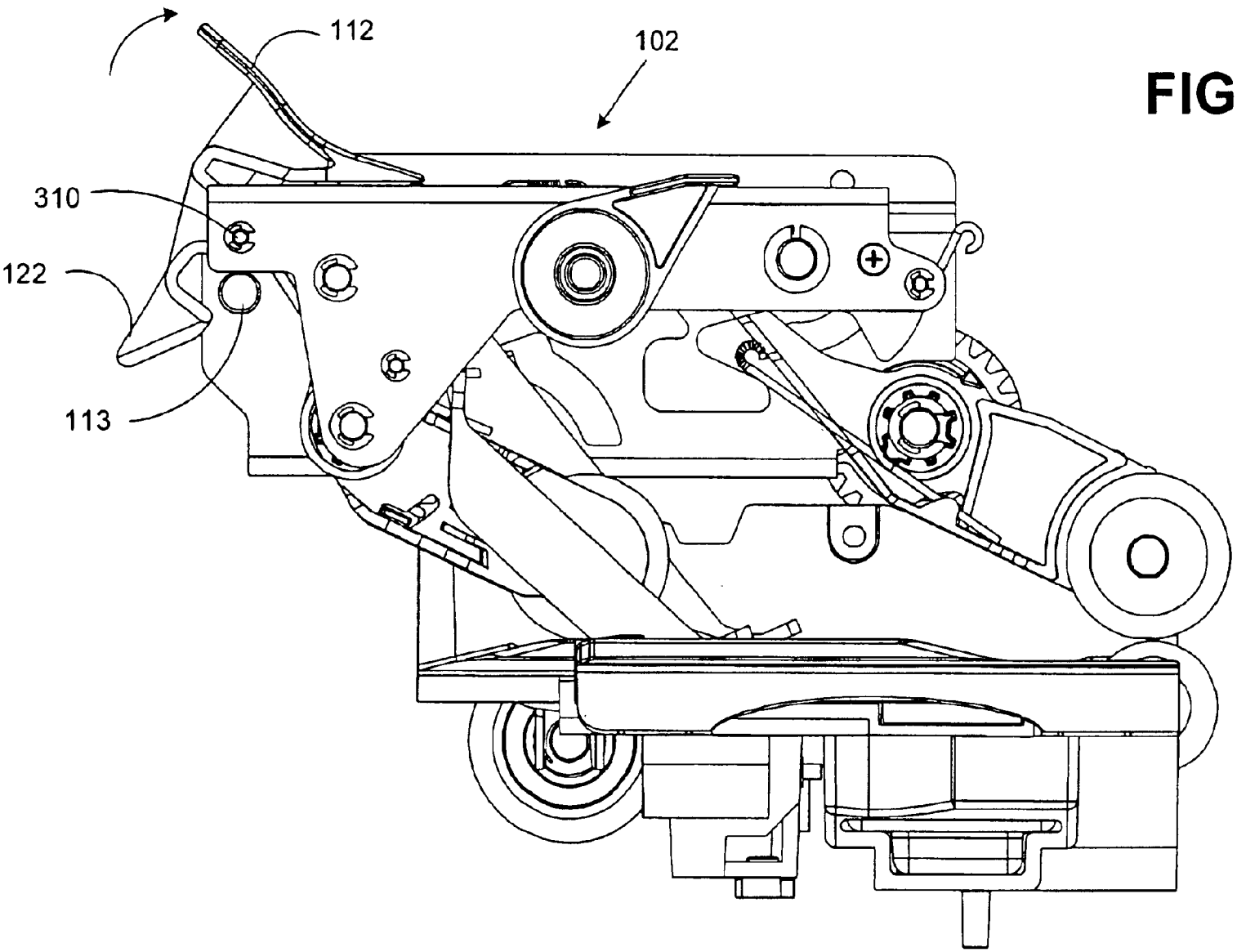
FIG. 3 illustrates a close up of a release handle rotating around a release handle pivot.

Referring now to FIG. 3, a close up illustration of the release handle 112 rotating around a release handle pivot 310 is shown. Rotating the release handle 112 causes the upper transport latch 122 to become released from the upper transport latch pin 113. Release of the upper transport latch 122 from the upper transport latch pin 113 allows the upper transport 102 to be lifted.

Figure 4:
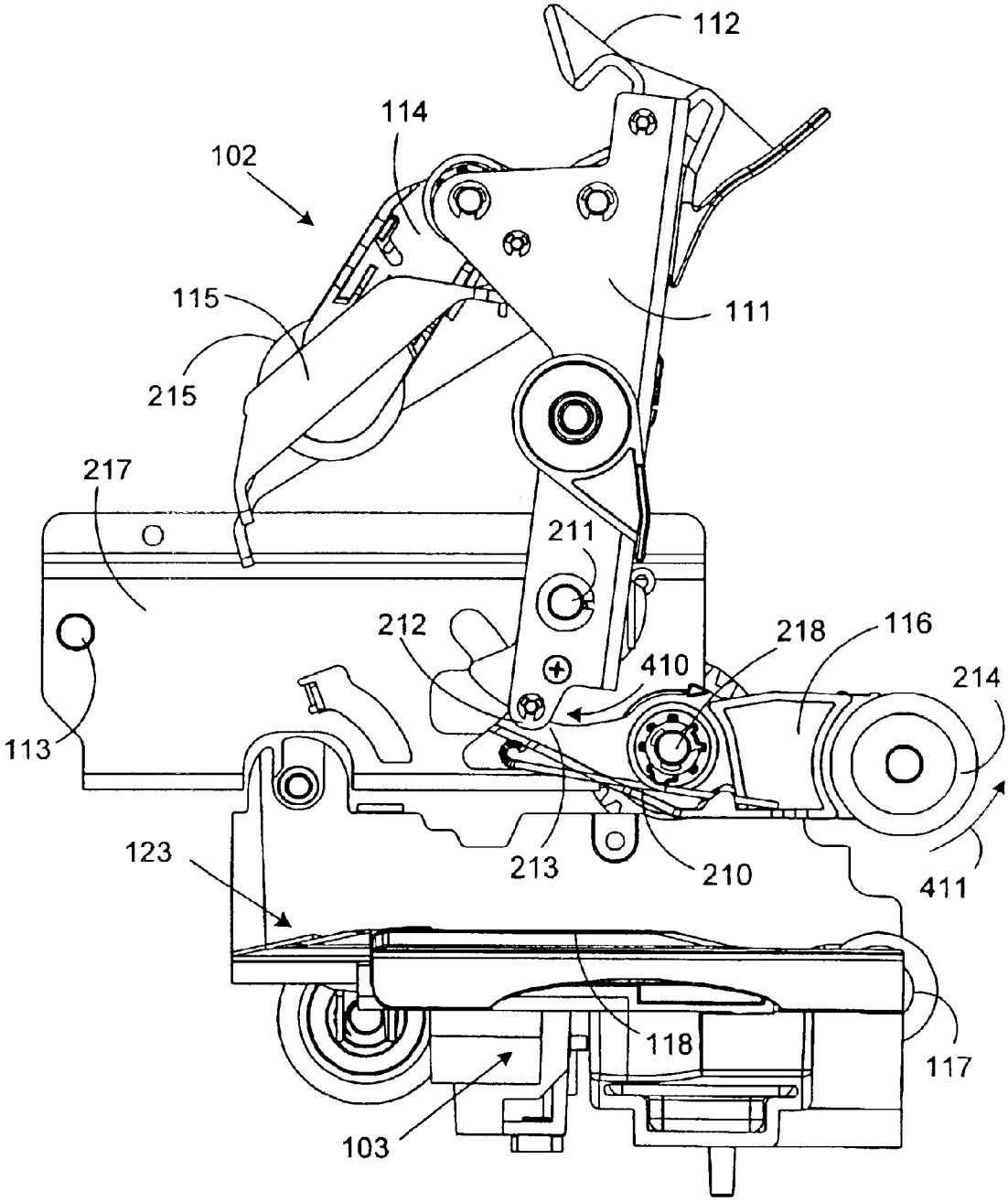
FIG. 4 illustrates an upper transport portion in an upright position exposing the transport deck and separator and moistener portion of the mailing machine.

Referring now to FIG. 4, the upper transport portion 102 is illustrated in the upright position exposing the transport deck 123 and separator and moistener portion 103 of the mailing machine 100. The first upper transport 114 and the second upper transport 116 are lifted away from the transport deck 123 allowing clear access to the transport deck 123 and the stripper blade 118 for the removal of a jammed mail piece or other purpose.

The upper transport portion 102 rotates over center around the upper transport pivot shaft 211 and can be held in position by the cam engagement rod 212 contacting the cam 213 formed into second upper transport 116. Normal pressure is applied by the torsion spring 210 pushing the cam engagement rod 212 against the cam 213 as the upper transport frame 111 rotates upward. The cam engagement rod 212 contacts the cam 213 at an engagement point 410. The second upper transport 116 can be rotatively mounted on a pivot 218 such that as the cam engagement rod 212 comes into contact with the cam 213 formed into or fixedly attached to the second upper transport 116, the second upper transport 116 is rotated away from the transport deck 123 and the stripper blade 118 as indicated by arrow 411.

Figure 5:
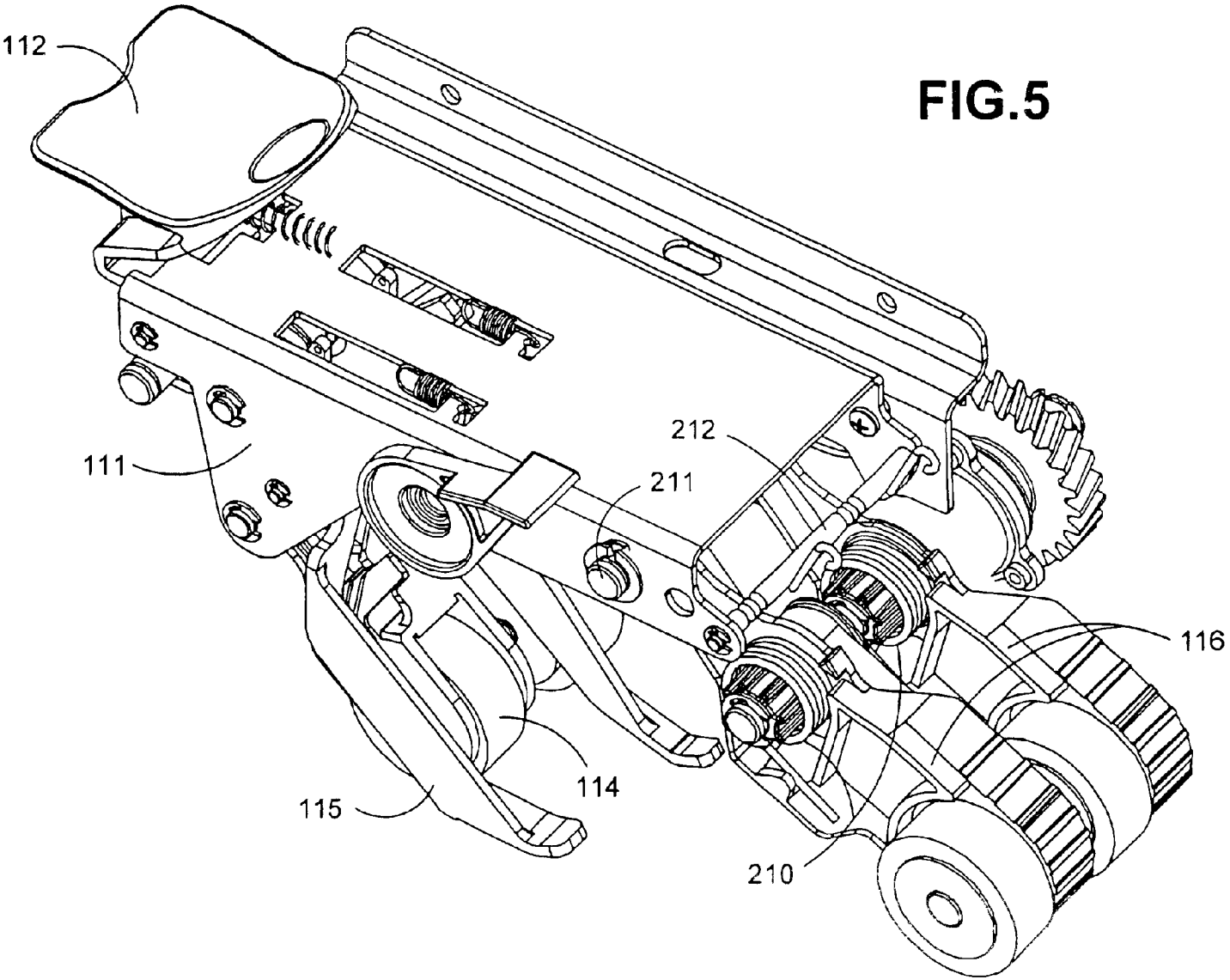
FIG. 5 illustrates a perspective view of an upper transport assembly according to the present invention.

Referring now to FIG. 5, a perspective of the upper transport 102 assembly is illustrated, further detailing exemplary representations of various features of the present invention. As illustrated, embodiments can therefore include an upper transport frame 111 with a cam engagement rod 212 inserted through the upper transport frame 111 and spanning across the width of the upper transport frame 111. A torsion spring 210 can be associated with each of two secondary upper transports 116. Other embodiments and designs can include various number of cams, springs, transports and the like. In addition, one or more skis 115 and primary upper transports 114 can also be included. An exemplary release handle 112 is also clearly shown in FIG. 5.

Figure 6:
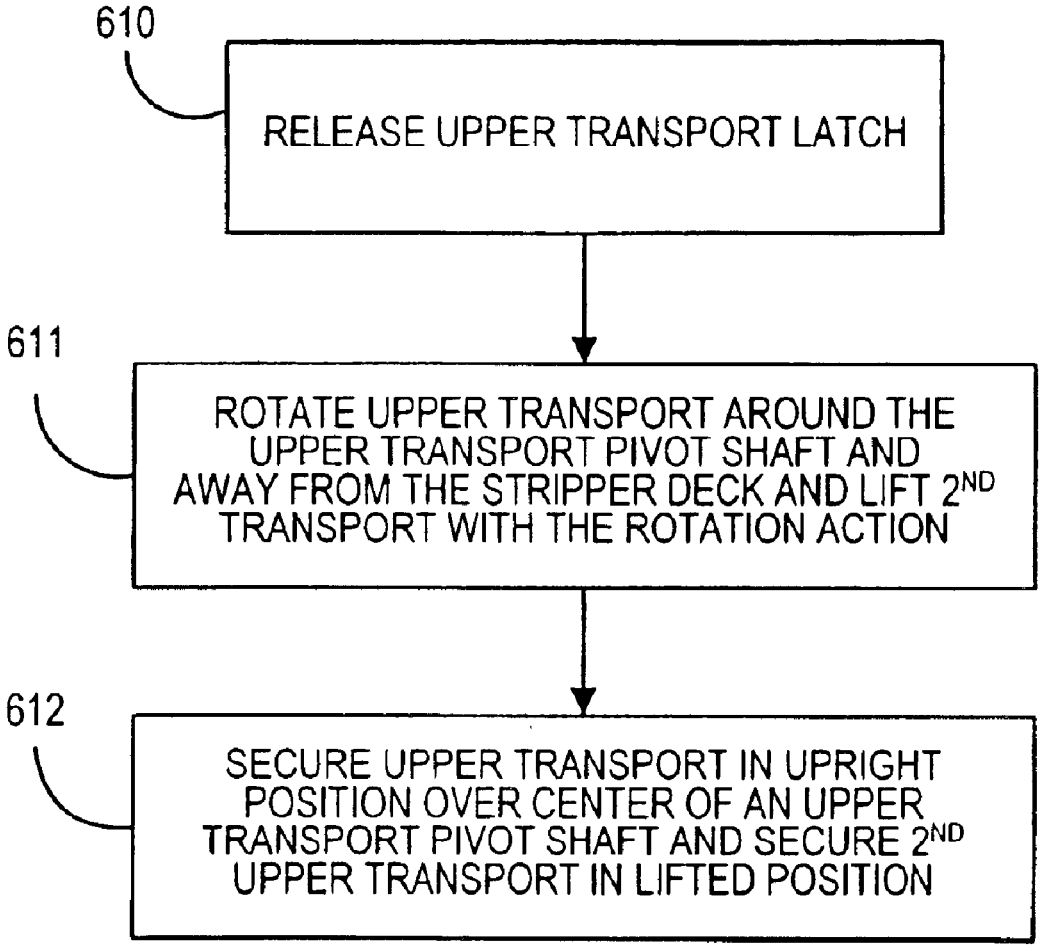
FIG. 6 illustrates a flow of steps that can be completed while practicing the present invention.

Referring now to FIG. 6, steps that can be taken while implementing the current invention are illustrated. At 610, access to the transport deck 123, stripper blade 118 and separator and moistener portion 103 can be facilitated by pivotally displacing the release handle 112 over center causing a release of the upper transport latch 122 from the upper transport latch pin 113. At 611, with the upper transport latch 122 released from the upper transport latch pin 113, the upper transport frame 111 can be rotated upward around the upper transport pivot shaft 211 and away from the transport deck 123. The upward movement of the upper transport frame 111 can simultaneously cause each second upper transport 116 to also move upward away from the transport deck 123. Embodiments can include, for example, the upper transport 102 rotating clockwise approximately 90° until the upper transport 102 is over center of the upper transport pivot shaft 211. The rotational movement can be carried through to the second upper transport 116 causing the second upper transport 116 to rotate around a pivot 218 and also be lifted up. At 612, the upper transport 102 can be secured in an upright position over center of the upper transport pivot shaft 211 and the second upper transport 116 can be secured in a lifted position held in place by the cam 213, thereby providing access to the transport deck 123.

The words "comprise," "comprises," "comprising," "include," "including," and "includes" when used in this specification and in the following claims are intended to specify the presence of stated features, elements, integers, components, or steps, but they do not preclude the presence or addition of one or more other features, elements, integers, components, steps, or groups thereof.

A number of embodiments of the present invention have been described. Nevertheless, it will be understood that various modifications may be made without departing from the spirit and scope of the invention. For example, the upper transport 102 can rotate clockwise or counter clockwise with appropriate location of the release handle 112 and pivot shaft 211. In addition, the upper transport can be rotated to a position other than over center of the upper transport pivot shaft 211. Any pivot 211, 218 can include a bearing. Other variations relating to implementation of the functions described herein can also be implemented. Accordingly, other embodiments are within the scope of the following claims.

What is claimed is:

1. A sheet feeding device comprising:

a transport deck;

an upper transport frame rotatively mounted to the sheet feeding device via an upper transport pivot shaft;

a latching means for securing the upper transport frame in a home position;

a first upper transport mounted to the upper transport frame, the home position of the upper transport frame positioning the first upper transport for contact with a mail piece on the transport deck;

a second upper transport pivotally mounted to the sheet feeding device; and a handle means for releasing the latch means;

wherein rotation of the upper transport frame from the home position into an open position lifts the first upper transport away from the transport deck, the rotation further causing the upper transport frame to contact the second upper transport and cause the second upper transport to pivot and lift away from the transport deck.

2. The sheet feeding device of claim 1 further comprising:

means to secure the upper transport frame in an open position.

3. The sheet feeding device of claim 2 wherein the means to secure the upper transport frame in an open position comprises a rod inserted through the upper transport frame contacting a cam on the second upper transport.

4. The sheet feeding device of claim 3 additionally comprising a spring, wherein the spring is positioned such that torque provided by the spring applies normal pressure against the cam while the upper transport frame is the open position.

5. The sheet feeding device of claim 4 wherein the spring torque additionally provides downward pressure against the second upper transport while the upper transport frame is in the home position.

6. The sheet feeding device of claim 1 wherein, if the upper transport frame is secured in the home position, a distance between the first upper transport and the second upper transport is less than a length of a mail piece having a shortest length intended to traverse the sheet feeding device.

7. The sheet feeding device of claim 1 additionally comprising:

one or more skis pivotally attached to the upper transport frame and positioned to guide a mail piece while the upper transport frame is secured in the home position.

8. The sheet feeding device of claim 7 wherein the one or more skis pivotally attached to the upper transport frame are lifted away from the transport deck when the upper transport frame is in the open position.

9. The sheet feeding device of claim 1 additionally comprising a stripper blade.

10. The sheet feeding device of claim 1 additionally comprising a nip following the stripper blade and formed by the second upper transport contacting a lower roller.

11. The sheet feeding device of claim 1 additionally comprising a singulator for creating a stream of single mail pieces.

12. The sheet feeding device of claim 1 wherein the latching means and the handle means are formed by one homogenous molded piece.

13. The sheet feeding device of claim 12 wherein the handle means is pivotally mounted to the upper transport frame.

14. The sheet feeding device of claim 1 wherein the latching means comprises a hook that engages a latch pin to secure the upper transport in the home position.

15. A method for providing access to a transport deck on a mailing machine, the method comprising:

releasing an upper transport frame latch;

rotating an upper transport frame around a pivot to lift a first upper transport away from the transport deck and into an upright position;

contacting a second upper transport with a portion of the upper transport frame during rotation of the upper transport frame; and causing the second upper transport to move away from the transport deck based on the rotation of the upper transport frame.

16. The method according to claim 15, further comprising:

securing the upper transport frame in the upright position.

17. The method according to claim 15, wherein the first upper transport is lifted to a position over center of a the pivot.

18. The method according to claim 15 wherein the upper transport frame is rotated clockwise.

19. A mailing machine comprising:

a transport deck for transporting a mail piece;

an upper transport frame rotatively attached to the mailing machine, the upper transport frame including a cam engagement rod;

a first upper transport attached to the upper transport frame and comprising one or more rollers for contacting a mail piece on the transport deck; and a second upper transport pivotally attached to the mailing machine and comprising one or more rollers for contacting a mail piece on the transport deck, the second upper transport including a cam;

wherein when the upper transport frame is rotated, the one or more rollers of the first upper transport are lifted away from the transport deck, the cam engagement rod contacts the cam of the second upper transport causing the second upper transport to pivot, and the one or more rollers of the second upper transport arc lifted away from the transport deck.

20. The mailing machine of claim 19, further comprising:

a latch pin fixedly mounted to the mailing machine; and a release handle pivotally mounted to one end of the upper transport frame where it can engage the latch pin while the upper transport frame is in a home position.

21. The mailing machine of claim 18 wherein the upper transport frame rotates clockwise and the second upper transport pivots in a counter-clockwise direction.

22. The mailing machine of claim 18 wherein the upper transport frame rotates to a position over center of a pivot shaft attaching the upper transport frame to the mailing machine.

* * * * *